United States Patent [19]

Del Mei

[11] 4,117,701

[45] Oct. 3, 1978

[54] ELECTRO-THERMAL LOCK

[76] Inventor: Luigi Giovanni Del Mei, 1178 Park St., Pretoria, South Africa

[21] Appl. No.: 823,642

[22] Filed: Aug. 11, 1977

[30] Foreign Application Priority Data

| | | | |
|---|---|---|---|
| Jan. 20, 1977 | [ZA] | South Africa | 77/0322 |
| Jun. 17, 1977 | [ZA] | South Africa | 77/3627 |
| Jun. 21, 1977 | [ZA] | South Africa | 77/3693 |

[51] Int. Cl.[2] ..... E05B 47/06

[52] U.S. Cl. ..... 70/150; 70/283; 70/DIG. 10; 70/DIG. 46; 292/DIG. 66

[58] Field of Search ..... 70/283, 277, 278, 152, 70/DIG. 10, DIG. 49, 150, DIG. 46; 292/DIG. 66, DIG. 69; 340/274 C, 227 R

[56] References Cited

U.S. PATENT DOCUMENTS

| | | | |
|---|---|---|---|
| 1,855,089 | 4/1932 | Boothe | 70/150 |
| 1,876,894 | 9/1932 | Fitz Gerald | 292/DIG. 66 |
| 2,209,574 | 7/1940 | Marsh | 70/150 X |
| 3,781,857 | 12/1973 | Stendig et al. | 340/227 R X |
| 4,032,180 | 6/1977 | Pohl | 292/DIG. 69 |

FOREIGN PATENT DOCUMENTS

| | | | |
|---|---|---|---|
| 2,124,895 | 11/1972 | Fed. Rep. of Germany | 292/DIG. 66 |
| 819 | 2/1974 | South Africa. | |

*Primary Examiner*—Rodney H. Bonck

*Attorney, Agent, or Firm*—Prutzman, Hayes, Kalb & Chilton

[57] ABSTRACT

This invention relates to a locking device having a latching element movable between a locking position and an inoperative position, operating means for moving the latching element, a blocking member movable to a blocking position for mechanically preventing the latching element from moving to its inoperative position. According to the invention, a plurality of thermally responsive elements are arranged or are individually bendable to form thermally responsive holding means for adopting a holding condition to temporarily hold the blocking member in the blocking position and, preferably, also to form thermally responsive safety means for normally adopting an inoperative condition. Thermo-electric means are associated with the thermally responsive means for individually and selectively heating the thermally responsive means to move the thermally responsive holding means from the holding condition thereby permitting the blocking member to move from the blocking position and for moving the thermally responsive safety means to a holding condition for holding the blocking member in the blocking position. Thus, the blocking member is permitted to move from said blocking position only on correctly energizing said thermo-electric means. Actuating means are provided for enabling said thermo-electric means to be selectively energized.

14 Claims, 11 Drawing Figures

ELECTRO-THERMAL LOCK

This invention relates to a locking device comprising a latching element movable between a locking position and an inoperative position, operating means for moving the latching element from the locking position to the inoperative position, and blocking means operable for preventing the operating means from moving the latching element from the locking position to the inoperative position.

Locking devices of this initially described kind are well known, being mainly operated by a key or combination release system. Locking devices operable by magnetic controls have also been proposed.

The applicant has realised that there is a need for personalised locking systems and, in his South African Pat. No. 74/819, has proposed a range of personalised locking systems which include locking devices and suitably designed rings for operating the locking devices. The rings can be worn as a conventional item of jewellery and the locking device can be opened only by the wearer of the ring or by a person having a ring with similar unlocking characteristics. In the present invention, the applicant provides a locking device which can be operated in a similar manner but which could be operated by other suitable actuating devices. The locking device of the present invention has a wide range of application.

According to the invention the blocking means of a locking device of the kind initially described comprises:

a blocking member movable to a blocking position for mechanically preventing the operating means from moving the latching element from the locking position to the inoperative position;

thermally responsive holding means for adopting a holding condition for temporarily holding the blocking member in the blocking position;

thermo-electric control means for heating said thermally responsive holding means to move said thermally responsive holding means from said holding condition, thereby permitting said blocking member to move from said blocking position; and actuating means operable in a predetermined mode for energising said thermo-electric control means.

Once the appropriate thermally responsive holding means have been moved from their holding conditions, the blocking means is free to move from its blocking position and the latching element can then be moved to its inoperative position. The device may further include an actuating device for co-operating with the actuating means to operate the actuating means. The actuating means may include a contact connected to a power source and a plurality of contacts connected to respective thermo-electric means. The actuating device can then include a plurality of connecting lines each joined to a respective contact and pre-arranged for engaging the actuating means to connect the power supply contact to selected contacts of the actuating means in the predetermined mode for energising the thermo-electric control means and thus causing the thermally responsive holding means to move from their holding conditions.

The locking device may further comprise thermally responsive safety means for normally adopting an inoperative condition; and thermo-electric safety control means for heating said thermally responsive safety means to move said thermally responsive safety means to a holding condition for temporarily holding the blocking member in the blocking position; said actuating means then including switching means for energising the thermo-electric safety control means upon operation of said actuating means in at least one mode other than said predetermined mode.

The provision of the thermally responsive safety means makes it necessary for the actuating device to be prearranged for engaging the actuating means to connect the power supply contacts to selected contacts of the actuating means for energising thermo-electric control means without energising thermo-electric safety control means. If a thermo-electric safety control means is energised, a thermally responsive safety means moves to a holding condition and temporarily holds the blocking member in its blocking position, preventing the latching element from being moved to its inoperative position. The security of the locking device has thus been considerably increased.

The locking device may additionally comprise at least one further thermo-electric means inoperative with respect to said blocking member; said actuating means including further switching means for energising said further thermo-electric means upon operation of said actuating means in at least one mode other than said predetermined mode. The further thermoelectric means need not necessarily transfer heat to thermally responsive means.

The use of such further thermo-electric means enables a locking device having thermally responsive means including a majority of thermally responsive safety means, a number of thermally responsive holding means and further thermo-electric means to be operable by a single actuating device. For example, if there are 4 thermally responsive holding means, 3 further thermo-electric means and a plurality of thermally responsive safety means, then 35 differently coded locking devices can be operated by a single actuating device, the individual locking devices being operable by different individual actuating devices in such a way that an individual actuating device for one locking device will not operate the other locks in the group of 35 locking devices but all devices are operable by a single, master, actuating device.

The device may include an alarm including thermally responsive alarm means responsive to and movable progressively by heat from the thermo-electric means so that if an excessive number of thermo-electric means are actuated or any thermo-electric means is activated for an excessive time, a warning device in an alarm circuit will be operated by predetermined movement of the thermally responsive alarm means. This can make it impossible for a person to continuously and repetitively test the locking device for obtaining unauthorised operation of the device. The alarm may include resilient means or electrothermally operable means for maintaining the warning device in an operative condition after the circuit has been rendered operable.

In a preferred form of the invention, the locking device is initially manufactured with a plurality of bendable thermally responsive elements arranged in the housing, the elements being individually bendable to form thermally responsive holding means for adopting a holding condition to temporarily hold the blocking member in the blocking position and thermally responsive safety means for normally adopting an inoperative condition. Thermo-electric means are thus associated with said thermally responsive holding means and said thermally responsive safety means for individually and selectively heating the thermally responsive means to move the thermally responsive holding means from the holding condition thereby permitting the blocking member to move from the blocking position and for moving the thermally responsive safety means to a holding condition for holding the blocking member in the blocking position, whereby the blocking member is permitted to move from said blocking position only on correctly energising said thermo-electric means. The actuating means enables said thermo-electric means to be selectively energised.

The locking device may have means for moving the blocking member to the blocking position and means for biassing the blocking member for movement from said blocking position. The actuating means can include a switch responsive to movement of the blocking member against the biassing means for energising one of the thermo-electric control means and thereby moving one of the thermally responsive holding means from its holding condition.

Embodiments of the invention will now be described, by way of example, with reference to the accompanying drawings, in which.

Figure 1:
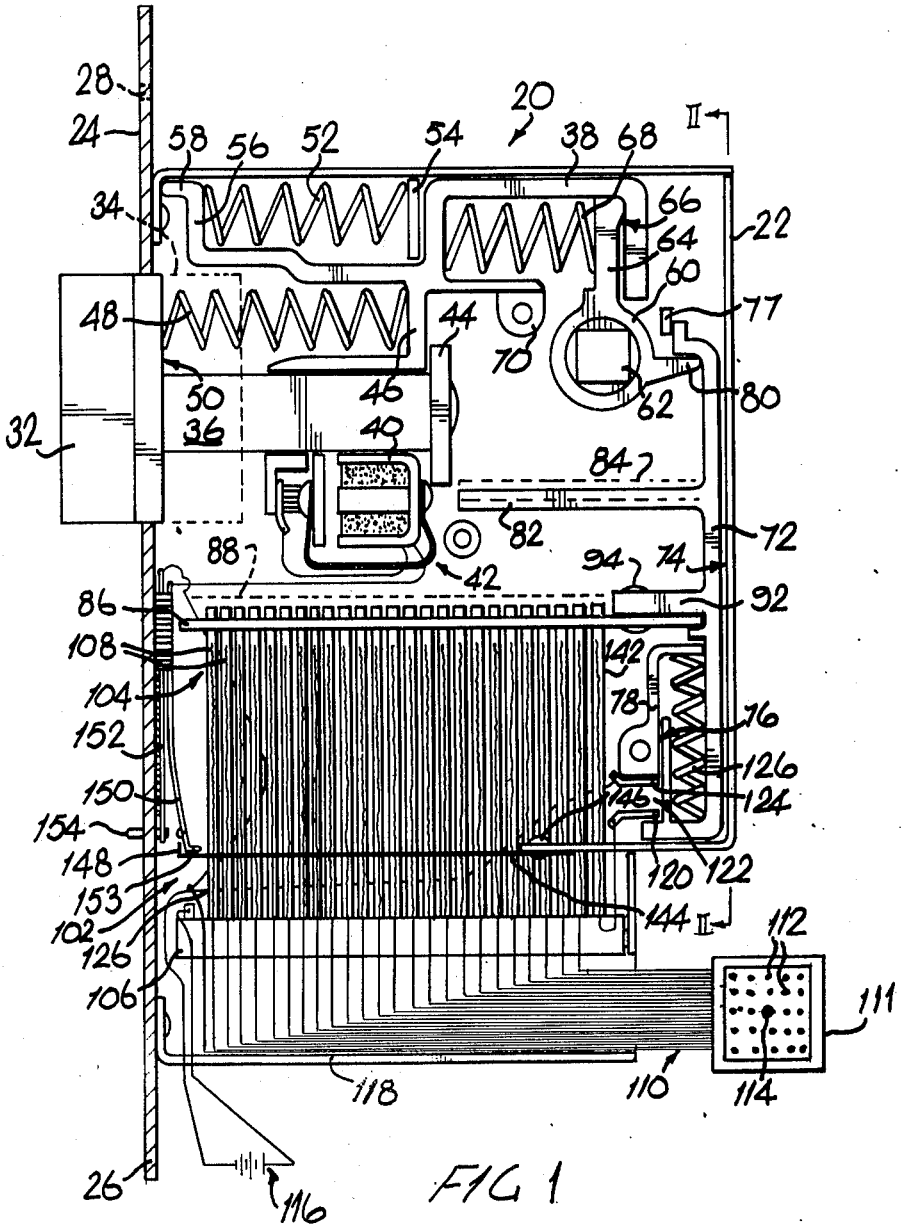
FIG. 1 is a cross-sectional side elevation through a locking device.
Figure 2:
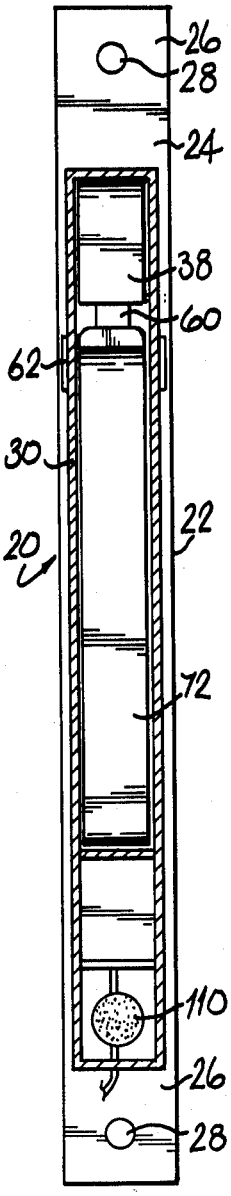
FIG. 2 is a cross-sectional end elevation on the line II–II in FIG. 1.
Figure 3:
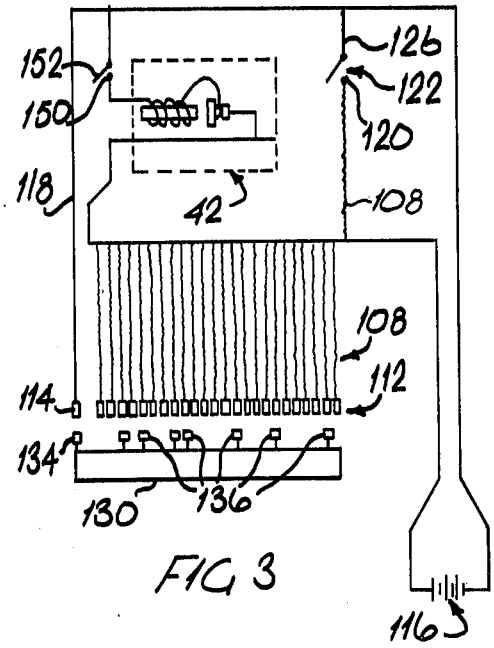
FIG. 3 is a circuit diagram showing the electrical circuit of the device of FIG. 1.

Referring firstly to FIG. 1, a locking device includes a housing 20 formed from a metal case 22 and a face plate 24. The face plate has mounting flanges 26 including openings 28 enabling the locking device to be mounted in a door in a conventional manner. The case 22 includes a removable side plate 30 which provides access to the interior of the locking device.

The locking device has a latch bolt 32 which is movable between a locking position (shown) and an inoperative position 34 shown in chain lines. The latch bolt has a shank 36 which is slidable between a slider 38 and a support 40 formed by a housing of an audible warning device 42. The shank also has an end plate 44 which abuts against a spring seat 46 of the slider 38 to prevent the latch bolt from leaving the housing 20.

A bolt biassing spring 48 fits in the spring seat 46 and presses against a rear face 50 of the latch bolt 32. The bolt biassing spring 48 thus tends to bias the bolt to its locking position. A primary spring 52, which is stronger than the spring 48, acts between a spring stop 54 fixed in the case 22 and a primary spring seat 56 on the slider 38. This primary spring 52 serves to bias the slider to the left hand side of the case until a stop 58 abuts against the case 22 and prevents further movement of the slider. Force applied to the latch bolt to force the latch bolt into the housing normally compresses the bolt biassing spring 48 without moving the slider 38. However, the slider can be moved to the right in FIG. 1 by turning a follower 60 fixed on a bush 62 in a clockwise direction.

The follower 60 has an arm 64 which extends into a cavity formed within the slider 38 and engages a follower seat 66 provided by the slider 38. The arm 64 is biassed against the follower seat 66 by a follower spring 68, the follower spring being compressed when the follower 60 is turned anticlockwise. A guide 70 is fixed to the case 22 and serves to guide the slider 38 during its movement.

The bush 62 is constructed to receive a square shank of a conventional door handle. When the follower and bush are pivoted to drive the slider to the right in FIG. 1, the latch bolt 32 is also moved to the right because of the engagement of the end plate 44 with the spring seat 46.

The locking device includes a blocking member 72 which is slidable against a wall surface 74 in the case 22 and is guided for movement by a surface 76 of a spring mount 78, a guide 77 annd a lifting arm 80 of the follower 60. The blocking member has a blocking arm 82 and is movable by the lifting arm 80 to a blocking position, the blocking position of the blocking arm being shown in chain lines at 84. When the blocking arm 82 is in its blocking position, the arm is located between the end plate 44 of the latch bolt 32 and the wall 74 of the housing and the latch bolt 32 is therefore prevented from moving from its blocking position to its inoperative position.

The blocking member 72 also includes a sensing arm 86 which moves to a blocking position (shown in chain lines) when the blocking member 72 is lifted by the lifting arm 80. The sensing arm 86 is shown in more detail in FIG. 4. As this Figure clearly shows, the arm has a mounting portion 90 which is secured to a mounting section 92 of the blocking member by a rivet 94. Two limbs 96 extend from the mounting portion 90 and are joined together at free end 98 of the sensing arm 86. A parallel-sided slot 100 is formed between the limbs 96.

The locking device includes a thermal control assembly 102 having a row of thermally responsive elements in the form of bimetallic strips 104 mounted on a suitable electrically insulating mounting block 106. In the embodiment shown 25 bimetallic strips are used. 25 thermo-electric means in the form of resistors 108 are fixed to the bimetallic strips so that the bimetallic strips act as power supply lines for the resistors. The other ends of 24 of the resistors are connected by suitably leads 110 one to each contact 112 in an actuating socket 111. The actuating socket also includes a power contact 114 which is connected to a power supply source 116 by a supply lead 118. The last of the resistors is connected to a contact 120 of a final activiating switch 122, the switch also including a contact 124 which is connected to the power supply 116 by supply line 126.

The power supply may be any suitable low voltage alternating or direct current supply of a voltage which for safety reasons is preferably not higher than 30 volts. A 12 volt supply is preferred.

The locking device is initially supplied with the bimetallic strips 104 parallel to one another and arranged so that when the blocking member 72 is moved to its blocking position, it will automatically be returned to its original position by release spring 126 acting between the spring mount 78 and the blocking member 72. The bimetallic strips in the embodiment shown are arranged to pass through the slot 100 in the sensing arm 86. Some of the bimetallic strips are shown in this position in FIG.

4. Furthermore, the bimetallic strips are arranged so that they will all bend in the same direction, that is in the direction of arrow 128 in FIG. 4, when heated by resistors 108.

Figure 4:
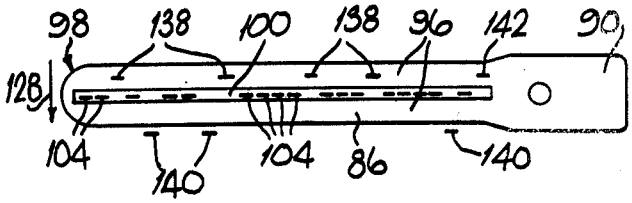
FIG. 4 shows a sensing arm of the device of FIG. 1.
Figure 10:
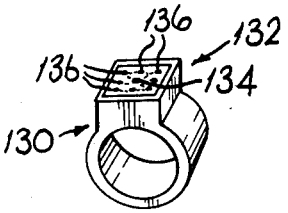
FIG. 10 shows an actuating device for the device of FIG. 1.

An actuating device in the form of a ring 130 is provided with a formation 132 for fitting snugly within the actuating socket 111. The ring, which is shown in FIG. 10, has a central contact 134 which is connected to further contacts 136. The central contact 134 is positioned to contact the power contact 114 of the actuating socket 111 and the 7 further contacts 136 are arranged to contact 7 of the contacts 112 in the actuating socket 111. The actuating ring 130 thus, in effect, forms a switch or bridge for actuating 7 of the resistors 108. When the ring is inserted in the actuating socket and the blocking member 72 has been moved to its blocking position, 7 of the resistors 108 are energised and thus heated and 7 of the bimetallic strips 104 are caused to bend. Th owner of the ring can then manually bend these 7 bimetallic strips 104 to selectively provide thermally responsive holding strips 138 and inoperative strips 140. In this case, 4 thermally responsive holding strips and 3 inoperative strips are provided as shown in FIG. 4. The strips 138 are bent so that when the respective resistors 108 are energised and heated, the strips 138 return to a position in which they are parallel to the strips aligned with the slot 100 in the sensing arm 86. The strips 140, on the other hand, are bent so that they never engage the sensing arm. The remaining strips 104 are not bent but remain aligned with the slot 100 to serve as thermally responsive safety strips. If they are heated, they will move out of alignment with the slot 100 to prevent the blocking member from being returned to its original position by release spring 126.

With a single master actuating ring 130 having 7 contacts 136 joined to a control contact 134 and by using only 4 thermally responsive holding strips and 3 inoperative strips, it is possible to provide, for example, up to 35 rings each having only 4 of the contacts 136 and each capable of operating a different locking device even though all of these locking devices can be opened by a single master ring. If a master ring is not required, the strips 140 can be bent in a similar manner to the strips 138 or can remain unbent and inoperative strips 140 become unnecessary.

That strip 142 which is connected to the resistor 108 which is itself connected to the contact 120 is also bent to the same extent as the strips 138 to form a thermally responsive holding strip. The contacts 120 and 124, which are provided, respectively, on the blocking member 72 and spring mount 78, are normally spaced from one another but can be brought into contact by elevating the blocking member above its blocking position by means of the lifting arm 80. Once this has been done, the strip 142 and its respective resistor connected to the contact 120 is energised and operates in exactly the same way as the strips 138. The reasons for lifting the blocking member is to ensure that the strips 104, including strip 142, are free of the sensing arm when heated, allowing them to move freely.

Figure 5:
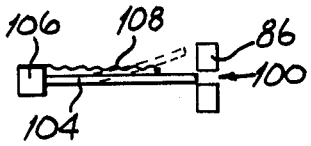
FIGS. 5 and 6 are schematic illustrations showing how thermally responsive elements operate in the device.
Figure 6:
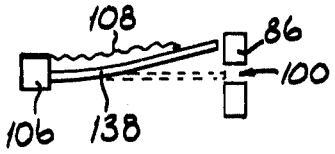

Once the strips 138 have been bent, the majority of the strips are in the position shown in FIG. 5 and the thermally responsive holding strips 138 and 142 are in the position shown in FIG. 6. If only the resistors 108 for the holding strips 138 and 142 are energised, the holding strips move to the position shown in chain lines in FIG. 6 and the release spring 126 forces the blocking member 72 to is normal position shown in FIG. 1 and the latch bolt is released to move freely. If, on the other hand, an incorrect ring is used or all of the contacts in the actuating socket are bridged to try to move the holding strips to the position shown in chain lines in FIG. 6, one or more of the strips 104 in the position shown in FIG. 5 will move beneath the sensing arm 86 and thus prevent the sensing arm from allowing the blocking member to return to its original position for releasing the latch bolt 32.

If the resistors 108 all have substantially the same electrical and thermal characteristics, it will not be possible to distinguish between the resistors heating the different bimetallic strips 104 by sensing any temperature variations in the locking device or sensing the resistive characteristics of the resistors 108. Furthermore, as the bimetallic strips will each take a certain amount of time to heat up and later to cool, there will always be a time lag before a person bridging incorrect contacts by means of the actuating socket will be able to operate the locking device in order to release the latch bolt 32. Because of this and because of the vast number of different combinations that are possible using the locking device of the invention, the time required to determine which are the correct contacts to bridge will, in practice, be prohibitive, making it unlikely that any unathorised person will be able to open the lock under normal circumstances. In addition, the action of the resistors 108 and bimetallic strips 104 in converting electrical energy to thermal energy and then into mechanical energy is a silent one and it will not normally be possible to detect the thermally responsive holding strips by listening to the lock.

It is possible to have two or more actuating sockets 111 for a single lock, in which case two or more people may each be provided with an actuating ring 130 for each energising some of the resistors 108 connected to thermally responsive holding strips 138, in which case the locking device can only be opened when the appropriate rings are placed in appropriate sockets.

In order to further increase the security of the locking device, an alarm including the audible warning device 42 is included. The alarm includes a bimetallic alarm strip 144 which extends close to but spaced from the row of resistors 108 for receiving heat equally from all of the resistors 108, the strip 144 being fixed to a flange 146 of the housing 22 by a rivet. The alarm strip 144 has a hooked end 148 which normally engages a leaf contact 150 and holds the contact 150 away from a fixed alarm contact 152. The fixed alarm contact 152, like the leaf contact 150, is a leaf spring but the contact 152 carries an alarm release pin 154 which projects a short distance through the face plate 24. The contacts 150 and 154 are normally insulated from one another, the leaf contact 150 being connected to the audible warning device 42 and then to the powersource 116 and the contact 152 being connected directly to the power source. The arrangement is such that the audible warning device 42 operates when the contacts 150 and 152 are brought together.

The alarm strip 144 is arranged so that it is heated whenever one or more of the resistors 108 is energised and it progressively bends away from the leaf contact 150 when it is heated. Thus, if an excessive number of resistors are heated or if the resistors are heated for an unusually long period of time, the alarm strip 144 will bend beyond a predetermined limit at which stage the hooked end 148 of the alarm strip 144 will release the leaf contact 150 and the leaf contact will spring into engagement with the fixed alarm contact 152. The leaf contact will be held in engagement with the fixed alarm contact by its own resilience and the audible warning device will continue to sound until the alarm release pin 154 is pressed and the alarm strip 144 has sufficiently cooled. Leaf contact 152 has a hooked portion 153 against which alarm strip hooked end 148 will rest if the alarm strip 144 has cooled. When the alarm release pin is pressed, it will deform the leaf contact 152 which in turn deforms the leaf contact 150 as they are contacting each other. The hooked end 148 of strip 104 will be pressing against hooked portion 153 and will slide off the hooked portion to a position in which it again holds leaf contact 150. Only when the engagement between contacts 150 and 152 is broekn is the alarm silenced. The alarm pin can, of course, only silence the alarm when the alarm strip 144 has cooled sufficiently. The audible warning device 42 may be any suitable conventional device.

The cover plate 30 of the case 22 can be attached to the remainder of the case in any simple and suitable manner to provide ready access to the interior of the case since, when the device is installed within a door or other suitable location, the case will not be readily accessible.

It is not particularly important to prevent access to the power source 116 as the locking device cannot be released without a supply of power. Furthermore, it is not necessary to prevent access to the leads 110 to the actuating socket as this will not assist an unauthorised person in causing the latch bolt 32 to be released. The actuating socket 111 can be mounted in a door adjacent to the locking device or in a wall, for example. In any case, the actuating socket can be mounted in a holder having two parts 156, which are identical to one another. The parts 156 have pins 158 and sockets 160 enabling them to be connected together and include grooves 162 which can receive edge portions of the actuating socket. Once the actuating socket has been mounted in the holder, the holder can be fixed in a suitable location. The holder 156 allows the socket 111 to be passed through an opening larger than itself while connected to the resistors 108 and lead 118 and to be held in the opening by the holder 156. When it is held by the holder, the socket cannot be pushed back through the opening.

Figure 7:
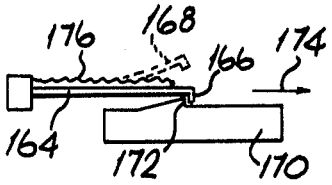
FIGS. 7 and 8 show alternative forms of thermally responsive devices.
Figure 8:
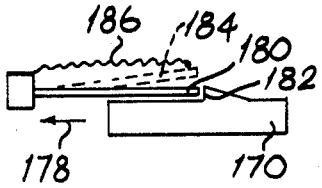
Figure 9:
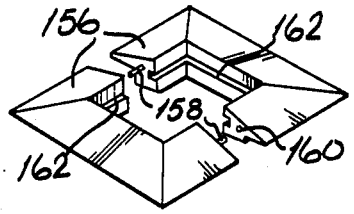
FIG. 9 shows a mounting for a key socket of FIG. 1.

The thermal control assembly 102 can be replaced by alternative forms, examples of which are shown in FIGS. 7 and 8. In FIG. 7, bimetallic holding strips 164 have hooked end portions 166 and are arranged to move to a position 168 shown in chain lines, when heated. The sensing arm 86 has been replaced by a bar 170 having a shoulder 172 which is engaged by the hooked portion 166 of the holding strip 164. When in the position shown, the bar 170 hold a blocking member in position and is free to move in the direction of arrow 174 only when all and only the holding members have been heated by energising resistors 176 in a manner similar to that in which the resistors 108 are heated. The thermal control assembly of FIG. 7 is also provided with safety strips which start in a position similar to the position 168 and which are movable, on being heated, to a position similar to the position of the holding strip 164 shown in solid lines in FIG. 7.

In FIG. 8, a bar 170 similar to the bar 170 of FIG. 7 is again used. However, this bar holds a blocking member in a blocking position when it is in the position shown and releases the blocking member only when it moves in the direction of arrow 178. Thermally responsive holding members in the form of bimetallic strips 180 engage shoulders 182 on the bar 170 and are movable to a position 184 shown in chain lines only when they are invidivually heated by resistors 186. Safety strips, normally in positions similar to the position 184 are movable to positions similar to that shown in solid lines upon being heated. The bar 170 is thus permitted to move in the direction of arrow 178 when only the holding strips 180 have been heated. Heating of even a single safety strip will prevent this. Clearly further variations are also possible.

Figure 11:
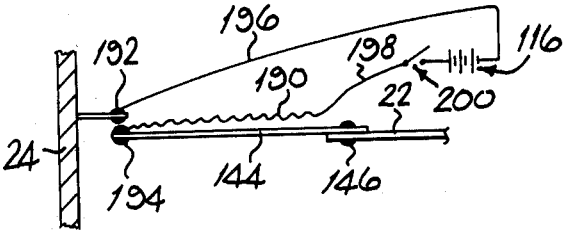
FIG. 11 shows part of an alarm system.

The alarm can also be modified. In a modification the alarm strip 144 is provided with but insulated electrically from a thermo-electric resistor 190 as shown in FIG. 11. The contacts 150 and 152 are omitted and a contact 192 is fixed to the face plate 24 for engaging a contact 194 carried by the strip 144 and connected to the resistor 190. The contact 192 and the opposite end of the resistor 190 are normally connected to the power supply 116 by leads 196 and 198, respectively. A switch 200 is provided in the line 198.

When the resistors 108 are unduly heated, the strip 144 bends as in FIG. 1. However, in the modification, this movement brings the contact 194 into engagement with the contact 196. This energises the resistor 190, which is heated and keeps the strip 144 in its bent condition. This holds the contacts in engagement. The alarm can only be silenced by means of switch 200, which can be located in a suitable position known only to authorised persons.

By using bendable bi-metallic strips 104, a manufacturer can supply the device with the contacts 112 and 114 already connected to their respective resistors 108 and power supply lead 118. The strips 104 can then be bent to suit the purchaser's requirements and the device can be readily adapted for use with a specific actuating ring. However, the strips 104 can be pre-bent if desired.

I claim:

1. A locking device comprising:

a latching element movable between a locking position and an inoperative position;

operating means for moving the latching element from the locking position to the inoperative position; and blocking means operable for preventing the operating means from moving the latching element from the locking position to the inoperative position;

wherein the blocking means comprises:

a blocking member movable to a blocking position for mechanically preventing the operating means from moving the latching element from the locking position to the inoperative position;

thermally responsive holding means for adopting a holding condition for temporarily holding the blocking member in the blocking position;

thermo-electric control means for heating said thermally responsive holding means to move said thermally responsive holding means from said holding condition, thereby permitting said blocking member to move from said blocking position;

actuating means operable in a predetermined mode for energising said thermo-electric control means to heat said thermally responsive holding means;

thermally responsive safety means for normally adopting an inoperative condition; and thermo-electric safety control means for heating said thermally responsive safety means to move said thermally responsive safety means to a holding condition for temporarily holding the blocking member in the blocking position;

said actuating means including switching means for energising the thermo-electric safety control means upon operation of said actuating means in at least one mode other than said predetermined mode.

2. The locking device of claim 1, further comprising:

at least one further thermo-electric means inoperative with respect to said blocking member;

said actuating means including further switching means for energising said further thermo-electric means upon operation of said actuating means in at least one mode other than said predetermined mode.

3. The device of claim 1, further comprising means for moving said blocking member to the blocking position; and means biassing said blocking member for movement from said blocking position;

wherein said actuating means includes switching means responsive to movement of said blocking member against said biassing means for energising a thermo-electric control means and thus moving a thermally responsive holding means from its holding condition.

4. The locking device of claim 1, further comprising:

a sensing arm on said blocking member and engageable by said thermally responsive means, said sensing arm having sensing surface means engageable by said thermally responsive means and said blocking member being movable on disengagement of said thermally responsive means from said sensing surface means.

5. The locking device of claim 1, further comprising:

an alarm including thermally responsive alarm means responsive to and movable progressively by heat from said thermo-electric means and an alarm circuit having a warning device, said circuit being operable by predetermined movement of said thermally responsive alarm means.

6. The locking device of claim 5, wherein said alarm includes resilient means for maintaining said warning device in an operative condition after the circuit has been rendered operable.

7. The locking device of claim 5, wherein said alarm means includes thermally operable means for maintaining said warning device in an operative condition after the circuit has been rendered operable.

8. The device of claim 1, wherein said thermally responsive means comprise bi-metallic strips and said thermoelectric means comprise resistive heaters associated with respective strips.

9. The locking device of claim 1, further comprising a housing and a fixed surface in said housing, said blocking member comprising a rigid element movable between said latching element and said fixed surface for preventing movement of said latching element to said inoperative position.

10. The locking device of claim 1, wherein said thermoelectric means have substantially identical electrical characteristics.

11. The device of claim 1, further comprising an actuating device for co-operating with said actuating means, wherein said actuating means includes a contact connected to a power source and a plurality of contacts connected to respective thermo-electric means and wherein said actuating device includes a plurality of connecting lines joined to respective contacts and prearranged for engaging said actuating means to connect said power supply contact to selected contacts of said actuating means for energising thermo-electric control means without energising thermo-electric safety control means.

12. A locking device comprising:

a housing;

a latching element located at least partly in said housing and movable between a locking position and an inoperative position;

operating means for moving the latching element from the locking position to the inoperative position;

a blocking member in said housing and movable to a blocking position for mechanically preventing the latching element from moving from the locking position to the inoperative position;

a plurality of bendable thermally responsive elements arranged in the housing, the elements being individually bendable to form thermally responsive holding means for adopting a holding condition to temporarily hold the blocking member in the blocking position and thermally responsive safety means for normally adopting an inoperative condition;

thermo-electric means associated with said thermally responsive holding means and said thermally responsive safety means for individually and selectively heating the thermally responsive means to move the thermally responsive holding means from the holding condition thereby permitting the blockking member to move from the blocking position and for moving the thermally responsive safety means to a holding condition for holding the blocking member in the blocking position, whereby the blocking member is permitted to move from said blocking position only on correctly energising said thermo-electric means; and actuating means for enabling said thermo-electric means to be selectively energised.

13. The locking device of claim 12, further comprising means for moving the blocking member to the blocking position and means for biassing the blocking member for movement from said blocking position, wherein the actuating means includes a switch responsive to movement of the blocking member against the biassing means for energising a thermo-electric control means and whereby moving a thermally responsive holding means from its holding condition.

14. The device of claim 13, further comprising an actuating device for co-operating with said actuating means, wherein said actuating means includes a contact connected to a power source and a plurality of contacts connected to respective thermo-electric means and wherein said actuating device includes a plurality of connecting lines joined to respective contacts and prearranged for engaging said actuating means to connect said power supply contact to selected contacts of said actuating means for energising thermo-electric means for moving the thermally responsive holding means.

* * * * *